United States Patent [19]

Tomii et al.

[11] Patent Number: 4,973,889

[45] Date of Patent: Nov. 27, 1990

[54] FLAT CONFIGURATION CATHODE RAY TUBE

[75] Inventors: Kaoru Tomii, Isehara; Hiroshi Miyama, Yokohama; Yoshikazu Kawauchi, Kawasaki, all of Japan

[73] Assignee: Matsushita Electric Industrial Co., Ltd., Japan

[21] Appl. No.: 472,979

[22] Filed: Jan. 31, 1990

[30] Foreign Application Priority Data

Feb. 1, 1989 [JP] Japan ..... 1-22872
Feb. 1, 1989 [JP] Japan ..... 1-22873

[51] Int. Cl.[5] ..... G09G 1/04; H01J 29/70
[52] U.S. Cl. ..... 315/366; 313/422
[58] Field of Search ..... 315/366; 313/422

[56] References Cited

U.S. PATENT DOCUMENTS 4,167,690 9/1979 Gange ..... 315/366

FOREIGN PATENT DOCUMENTS 56-79845 6/1981 Japan .
5671255 7/1988 Japan .

*Primary Examiner*—Gregory C. Issing
*Attorney, Agent, or Firm*—Lowe, Price, LeBlanc, Becker & Shur

[57] ABSTRACT

A flat configuration CRT having positioned behind one or more line cathodes an array of control electrodes for electron beam modulation and shield electrodes for mutually shielding the control electrodes, in which the shield electrodes are connected as a plurality of electrically separate blocks. DC voltages applied to the respective blocks are adjusted such as to establish identical levels of beam current for electron beams which are generated by emission from the line cathodes, thereby enabling accuracy requirements for spacing between these electrodes and the line cathodes to be substantially reduced.

4 Claims, 4 Drawing Sheets

FLAT CONFIGURATION CATHODE RAY TUBE

BACKGROUND OF THE INVENTION

1. Field of Applicable Technology

The present invention relates to a flat configuration cathode ray tube (hereinafter abbreviated to CRT), and in particular to an improved flat configuration CRT of a type in which electron beam modulation is executed by beam control electrodes which are disposed behind and closely adjacent to an array of line cathodes used as an electron beam source.

2. Prior Art Technology

A flat configuration CRT of a type employing beam control electrodes positioned behind an array of line cathodes (i.e. positioned on the opposite side of that array of cathodes from the direction of emission of electron beams derived therefrom) is described in the prior art, for example in Japanese Patent Laid-open Nos. 63-37938 and 56-79845. With such a CRT, a plurality of line cathodes and a first grid electrode having an array of through-holes formed therein are disposed mutually opposing. These through-holes are arranged in a plurality of horizontal rows, i.e. each row being positioned in correspondence with one of the line cathodes, for forming a row of electron beams from electrons which are emitted from that corresponding cathode. These electron beams then pass through deflection and acceleration electrodes, to be directed onto a fluorescent layer formed on a transparent faceplate of the CRT. In addition, a plurality of elongated electron beam control electrodes extending at right angles to the line cathodes are positioned behind the line cathodes, for controlling the respective intensities of the electron beams in accordance with signal voltages applied to these beam control electrodes, i.e. for modulating the electron beams in accordance with the contents of a video signal to thereby display a corresponding picture. The set of beam control electrodes also function to direct the electrons emitted from each line cathode in the required direction for electron beam generation.

A typical configuration of such a prior art flat configuration CRT will be described referring to FIG. 1. Here, numeral 1 denotes line cathodes each formed of a high melting-point metal wire such as tungsten wire, and having a electron emission material coated on the surface thereof. A plurality of these line cathodes are held in tension, mutually parallel, extending in the horizontal direction, and are heated to obtain emission of electrons (where the terms "horizontal" and "vertical" directions as used herein signify directions respectively parallel to the horizontal and vertical directions of a picture displayed by the CRT). Numeral 2 denotes a set of elongated vertically extending electron beam control electrodes, and numeral 12 denotes a set of elongated vertically extending shield electrodes. The shield electrodes 12 and electron beam control electrodes 2 are formed at successively alternating positions on an electrically insulating substrate 3, which is formed of a material such as glass or ceramic. Generally, a portion of a glass envelope of the CRT can be used as the electrically insulating substrate 3. A fixed spacing is established between the array of line cathodes 1 and the array of electron beam control electrodes 2. Each of the line cathodes 1 is retained under tension by a spring (not shown in the drawings) attached to at least one end thereof. Numerals 4 and 7 denote first and second grid electrodes for respectively forming and focussing the electron beams, having arrays of through-holes 5 and 8 respectively formed therein, arranged in rows which are oriented parallel to and positioned in correspondence with respective ones of the line cathodes 1. The diameters of the through-holes 5 and 8 are determined by the requisite electron beam size and the position relationships of the various electrodes.

The electron beam forming grid electrode 4 has the through-holes 5 formed therein at positions which correspond to respective positions of intersection between the electron beam control electrodes 2 and the line cathodes 1. Numeral 6 denotes vertical deflection electrodes for deflecting the electron beams in the vertical direction. The apertures 8 in the grid electrode 7 are of elongated shape and correspond in horizontal position to the through-holes 5 that are formed in the electron beam forming grid electrode 4. The grid electrode 7 serves to shield the vertical deflection electrode 6 from the effects of a high electric field that results from a high voltage applied to a metal back electrode 9 (described hereinafter). A transparent faceplate 11 has an electroluminescent layer 10 formed on an inner surface thereof and also has a metal back electrode 9 formed thereon.

With such a CRT, since the electron beam control electrodes are closely mutually adjacent, the control characteristics of each of these electrodes may be affected by changes in potential of adjacent ones of the electron beam control electrodes, i.e. crosstalk. To prevent such crosstalk, a set of shield electrodes 12 can be utilized as shown in the oblique view of FIG. 2. As shown, the shield electrodes 12 are formed on the electrically insulating substrate 3 at positions which alternate with those of the electron beam control electrodes 2, with all of the shield electrodes 12 being mutually electrically connected at one end thereof (to which a fixed DC voltage is applied). Fixed spacings are established between the electron beam control electrodes 2, the line cathodes 1 and the shield electrodes 12, with these elements being placed as mutually closely as possible.

The operation of the prior art example of FIG. 3 is as follows. Each of the electron beam control electrodes is connected through one of a set of resistors r1, r2, r3, . . . to a negative bias voltage source $V_1$. One end of each of the line cathodes 1 is connected through a respective one of a set of resistors R1, R2, R3, . . . to a positive bias voltage source $V_2$, while the other ends of the line cathodes 1 are connected through respective ones of a set of diodes $D_1$, $D_2$, $D_3$, . . . to the negative bias voltage source $V_2$. A positive voltage is applied to the electron beam forming grid electrode 4 from a voltage source $V_3$. The line cathodes 1 are normally connected to receive a current flow from the voltage source $V_2$, for heating. However once in each vertical scanning interval, when a cathode is to be utilized to derive a row of electron beams during a fixed interval, a negative voltage pulse is applied (from the corresponding one of a set of terminals A1, A2, A3, . . . ) to that cathode to thereby halt the flow of heating current through the cathode and also bias the cathode in a direction tending to enable electron emission therefrom. In this condition, if a positive voltage pulse is applied to one of the beam control electrodes 2 (i.e. from a corresponding one of the input terminals B1, B2, B3, . . . ), then the inhibiting effect of a negative voltage normally applied to that beam control electrode through the corresponding one of the resistors r1, r2, r3, . . . from the voltage source V1 will be removed for the duration of that pulse, and a high level of electron emission from that cathode will occur. In this way, a row of modulated electron beams can be derived from the corresponding row of apertures in the first grid electrode 4. Thus for example by applying respective pulse-width modulated signals in parallel to the input terminals B1, B2, B3, . . . in accordance with the contents of a video signal, the electron beams can be modulated in accordance with that video signal, to thereby display a corresponding picture by the CRT. The line cathodes 1 are successively switched to the "emission possible" condition by the negative pulses applied to the terminals A1, A2, A3 . . . for a fixed interval during each vertical scanning interval, sequentially from the uppermost to the lowermost cathode.

The electron beams that are thus selectively transferred through the through-holes 5 formed in the electron beam forming grid electrode 4, then are deflected by the vertical deflection electrodes 6, to be then accelerated by the high voltage that is applied between the grid electrode 7 and the metal back electrode 9, to thereby impinge upon the electroluminescent layer 10 of the image display faceplate 11 and so produce a display picture.

However with such a prior art flat configuration image display apparatus, due to the fact that the separation between the line cathodes 1 and the electron beam control electrodes 2 is very small, even a slight change in that separation will result in a large change in the electron beam current that is derived from the line cathodes 1. As a result, a very high degree of accuracy is necessary for the flatness of the insulating substrate 3 on which the electron beam control electrodes are formed, and also for the spacing between the line cathodes 1 and the electron beam control electrodes 2. Thus, a prior art CRT of this type presents serious problems with regard to ease of manufacture and manufacturing yield.

Moreover with prior art examples of this type of flat configuration CRT in which shield electrodes 12 are incorporated with a fixed voltage being applied in common to all of the shield electrodes, there is no description of how the value of that fixed voltage can be optimized such as to provide a maximum level of electron beam current together with effective shielding of mutually adjacent electron beam control electrodes.

SUMMARY OF THE INVENTION

It is a first objective of the present invention to overcome the above problem of a very high accuracy of component spacing being required, by providing a flat configuration cathode ray tube in which a high quality of display image can be obtained with substantially lower levels of spacing accuracy between electron beam control electrodes and line cathodes of the cathode ray tube, by comparison with the prior art.

It is a second objective of the present invention to provide a flat configuration cathode ray tube in which respective values of DC voltage that are applied to an array of shield electrodes, which serve to shield mutually adjacent ones of an array of electron beam control electrodes of the cathode ray tube, are selected to be optimum with respect to obtaining a high level of electron beam current while ensuring effective shielding action of the shield electrodes.

To achieve the first of the above objectives, a flat configuration CRT according to the present invention has an array of shield electrodes disposed for mutually shielding respective ones of an array of electron beam control electrodes disposed behind and closely adjacent to an array of line cathodes, with the shield electrodes of each of successive blocks of the shield electrodes being mutually electrically connected and separate from the other blocks of shield electrodes, and with respective voltages being applied to these blocks of shield electrodes which have appropriate values for correcting for non-uniformity of electron beam emission resulting from inaccuracies of spacing between the electron beam control electrodes and the line cathodes.

To achieve the second of the above objectives, a flat configuration CRT according to the present invention has an array of shield electrodes disposed for mutually shielding respective ones of an array of electron beam control electrodes disposed behind and closely adjacent to an array of line cathodes, with respective levels of DC voltage which are applied to the shield electrodes (or a DC voltage which is applied in common to all of the shield electrodes) being made more negative than a cut-off voltage level of the electron beam control electrodes.

More specifically, according to a first aspect, a flat configuration cathode ray tube according to the present invention comprises a plurality of electron beam control electrodes and plurality of shield electrodes, the electron beam control electrodes and shield electrodes each being of elongated form and arrayed at mutually alternating positions adjacent to at least one line cathode and oriented at right angles to the line cathode, and is characterized in that the shield electrodes are configured as a plurality of blocks each formed of a fixed plurality of the shield electrodes, each of the blocks being coupled to a corresponding connecting lead, and in further comprising a plurality of adjustable DC voltage sources coupled to respective ones of the connecting leads.

According to a second aspect, a flat configuration CRT according to the present invention is further characterized in that for each of the aforementioned voltage sources, an output voltage produced therefrom is set to a value which is more negative than a corresponding value of cut-off voltage of an electron beam control electrode which is disposed within one of the blocks which receives that output voltage.

As a result, with the present invention, even if there is non-uniformity in the spacing between the line cathodes and the electron beam control electrodes, or non-uniformity of electron beam emission performance at various positions along the line cathodes, overall uniformity of electron beam emission characteristics can be obtained for all regions of the line cathodes. Thus, the requirements for component dimensional accuracy and for accuracy of assembly operations of such a CRT can be very substantially relaxed by comparison with the prior art.

In addition, the invention enables the respective voltages applied to the shield electrodes to be optimized with regard to obtaining a maximum level of beam current for each of the electron beams.

DESCRIPTION OF PREFERRED EMBODIMENTS

Figure 3:
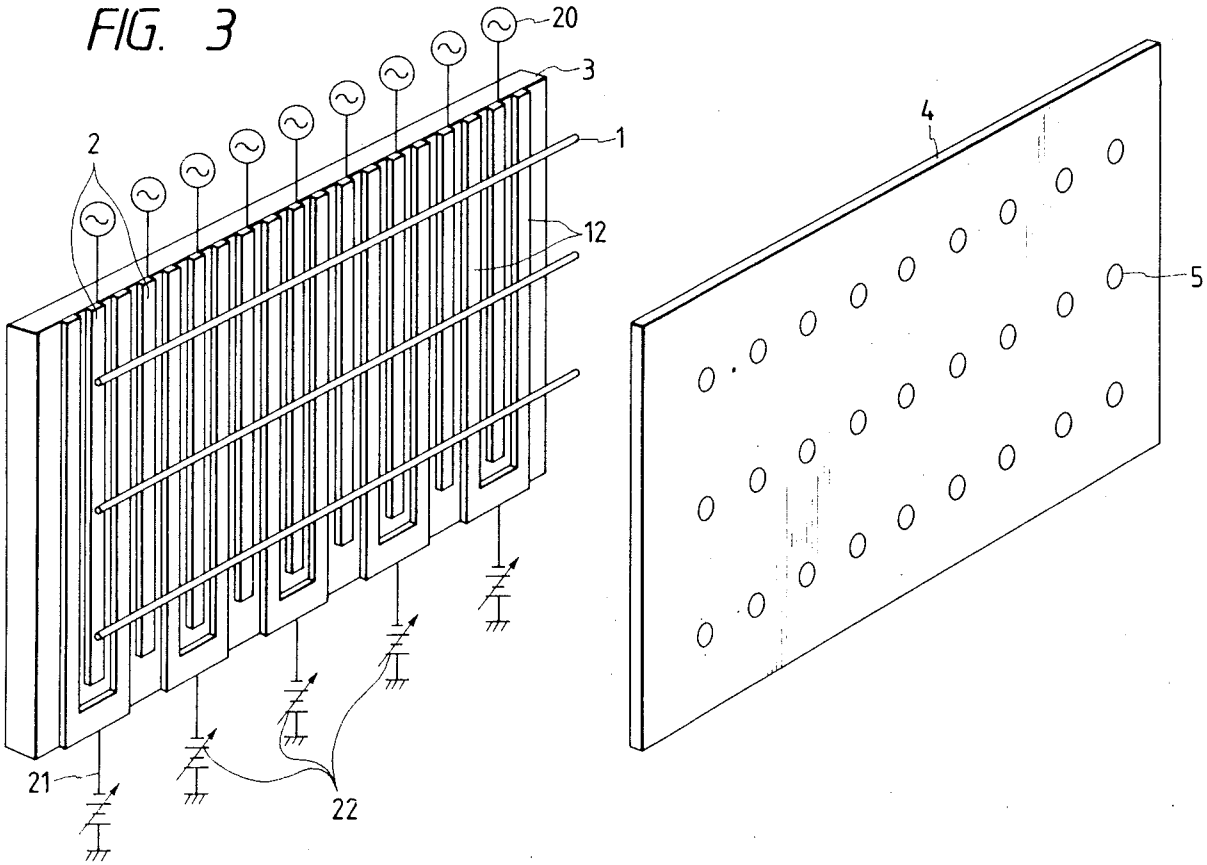
FIG. 3 is an oblique view showing essential portions of an embodiment of a flat configuration CRT according to the present invention.

Embodiments of the present invention will be described in the following referring to the drawings. FIG. 3 is a partial oblique view showing essential components for generating electron beams in an embodiment of a flat configuration CRT according to the present invention.

As shown in FIG. 3, the flat configuration CRT comprises, as for the prior art example described above, an array of line cathodes 1, an array of electron beam control electrodes 2 alternatingly arranged on an insulating plate 3 with an array of a shield electrodes 12, and an electron beam forming grid electrode 4 etc, with the electron beam control electrodes and shield electrodes 12 being formed on the opposite side of the line cathodes 1 from an electron beam emission direction of the line cathodes 1 and being oriented vertically, i.e. at right angles to the line cathodes 1. The electron beam control electrodes 2 are coupled to respective ones of a plurality of modulation signal sources 20, with the electron beam currents that are emitted from the line cathodes 1 being modulated by voltages which are supplied from these sources 20, as described hereinabove. The shield electrodes 12 are divided into a plurality of blocks, each block consisting of a plurality of mutually connected shield electrodes. In this embodiment, each shield electrode block consisting of two electrodes, i.e. with each of the beam control electrodes 2 being enclosed between a corresponding pair of the shield electrodes 12 as shown. The ends of the electrodes of each block are connected to form a comb-shaped unit, with each block being connected to a corresponding one of a set of connecting leads 21. The connecting leads 21 are connected to respective ones of a set of shield electrode voltage sources 22 which produce respective voltages. The voltages that are thus applied through the connecting leads 21 to the blocks of the shield electrodes 12 are set to respective correction values for the various the shield electrode blocks, and can either be fixed DC values, or can attain successive fixed DC values during fixed time intervals corresponding to respective ones of the line cathodes within each vertical scanning interval, as described hereinafter.

Figure 2:
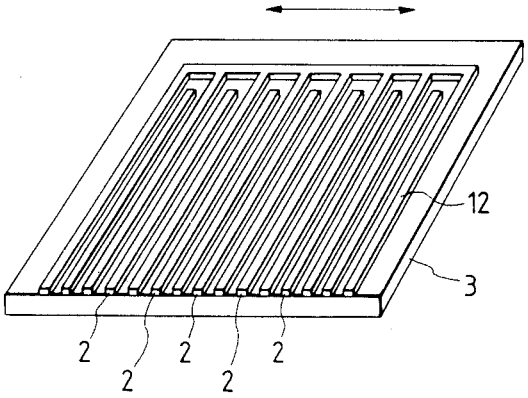
FIG. 2 PRIOR ART
FIG. 2 is an oblique view showing an example of a an array of electron beam control electrodes and shield electrodes, in a prior art flat configuration CRT.
Figure 4:
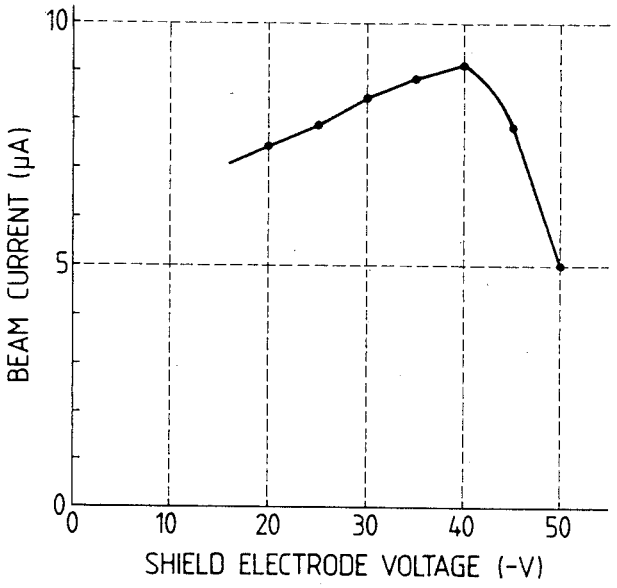
FIG. 4 is a graph showing the results of measurements of the relationship between shield . electrode voltage and emitted electron beam current in a flat configuration CRT.

The basic operation of this embodiment of the invention is identical to that of the prior art example described above, so that further description of that will be omitted, with only the correction function of the shield electrode blocks being described. FIG. 4 shows typical electron beam emission characteristics for the electrode configuration of FIG. 2. Specifically, FIG. 4 shows the electron beam current characteristic for an electron beam which passes through a single through-hole 5 of the electron beam forming grid electrode 4. The values plotted in FIG. 4 are based upon a value of spacing between the line cathodes 1 and the electron beam control electrodes 2 of 200 μm, a spacing between the line cathodes 1 and the electron beam forming grid electrode 4 is 1 mm, with variations of electron beam current in response to changes in the voltage applied to the shield electrodes 12 being measured under the conditions of an electron beam forming electrode voltage of 30 V, a line cathode 1 bias voltage of −10 V, and an electron beam control electrode voltage of −6.5 V.

As will be clear from the measurement results, the electron beam emission current from a line cathode can be controlled by varying the voltage applied to the shield electrodes 12. Thus, even if deviations in the electron beam emission characteristics occur at different positions along the line cathodes 1 due to non-uniformity of the spacing between the line cathodes 1 and the electron beam control electrodes (e.g. due to surface irregularities in the insulating substrate formed of a material such as glass on which the electron beam control electrodes are formed), or because of non-uniformity of electron emission performance of different portions of the line cathodes 1 themselves, thereby causing the electron beam emission characteristics to be non-uniform, it becomes possible to reliably establish uniform electron beam emission characteristics by appropriately adjusting the respective voltages that are applied to the blocks of the shield electrodes 12.

Thus with the embodiment of FIG. 3, the respective voltage levels produced from the voltage sources 22 are adjusted until uniform electron beam emission is obtained.

It would be possible to establish fixed values for these respective voltage levels from the voltage sources 22, and thereby obtain improved uniformity of electron beam emission over the prior art. However as described above, with such a flat configuration CRT, the line cathodes 1 are successively utilized for deriving rows of electron beams within each vertical scanning interval during respective short time intervals in that vertical scanning interval. For that reason, it may be preferable to execute dynamic correction for beam emission non-uniformity. That is to say, respectively different sets of optimum values for the DC voltages produced from the voltage sources 21 can be established for each of the line cathodes 1, i.e. a set of voltage values which provides maximum uniformity of emission from the uppermost one of the line cathodes 1, a set of values which is optimum for the next cathode, and so on. Thereafter, the voltage sources 21 can be controlled (by means not shown in the drawings) such as to successively establish these sets of output values from the voltage sources 21 during each vertical scanning interval, i.e. with each set of values being generated while a row of electron beams are being generated by emission from the corresponding one of the line cathodes 1.

It will be apparent that circuits can be readily implemented for executing such switching of successive sets of voltage values to be applied to the respective blocks of the shield electrodes 12, by means which are well known in the art, so that no description of specific circuits is given.

The above embodiment has been described for the case in which the shield electrodes 12 is divided into respective blocks each coupled to a connecting lead 21. Each of these leads 21 is brought out to the exterior of the CRT (i.e. passing through the glass envelope of the CRT) to the voltage sources 21. However it should be noted that it would be equally possible to leave the various electrodes of the shield electrodes 12 mutually separate, and to bring out individual connecting leads from these to the exterior of the evacuated envelope of the flat configuration CRT, with these then being connected to respective voltage sources 21, to thereby form the shield electrode blocks externally.

Furthermore, the present invention is not limited to the embodiment described above, and is equally applicable to any other form of flat configuration CRT having an array of shield electrodes and electron beam control electrodes disposed behind one or more line cathodes from which electron beams are derived.

It can thus be understood that the above embodiment enables precise uniformity of emission to be obtained for all of the electron beams of a flat configuration CRT which has electron beam control electrodes disposed at the rear of the cathodes, even if there is non-uniformity of spacing between the cathodes and the electron beam control electrodes, or non-uniformity of electron emission characteristics at different positions along the cathodes. Thus, the manufacture of such a CRT can be simplified and the manufacturing yield increased.

Figure 1:
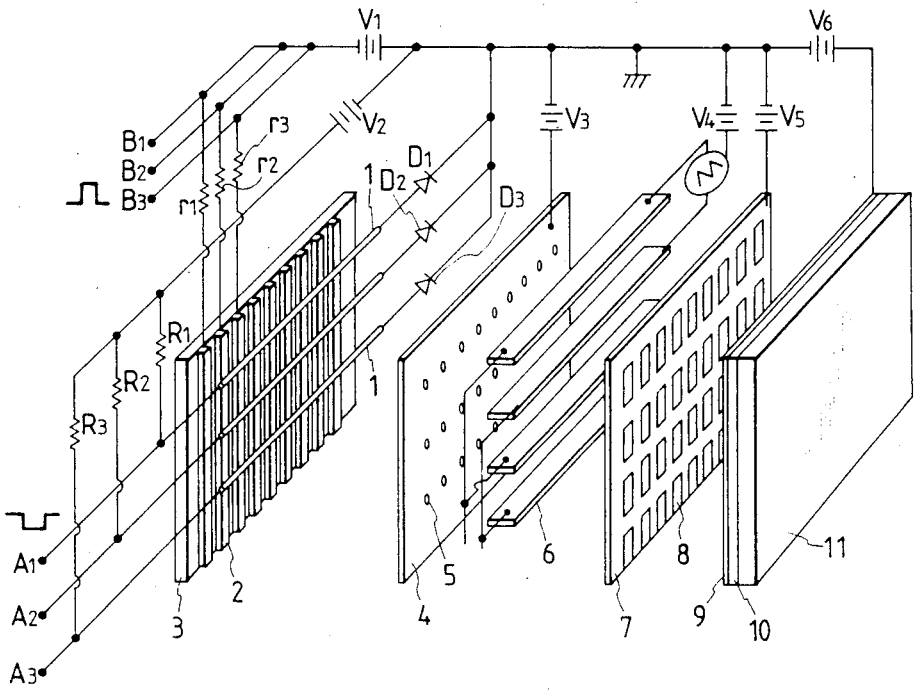
FIG. 1 PRIOR ART
FIG. 1 is an oblique view showing the basic elements of a prior art flat configuration CRT.
Figure 5:
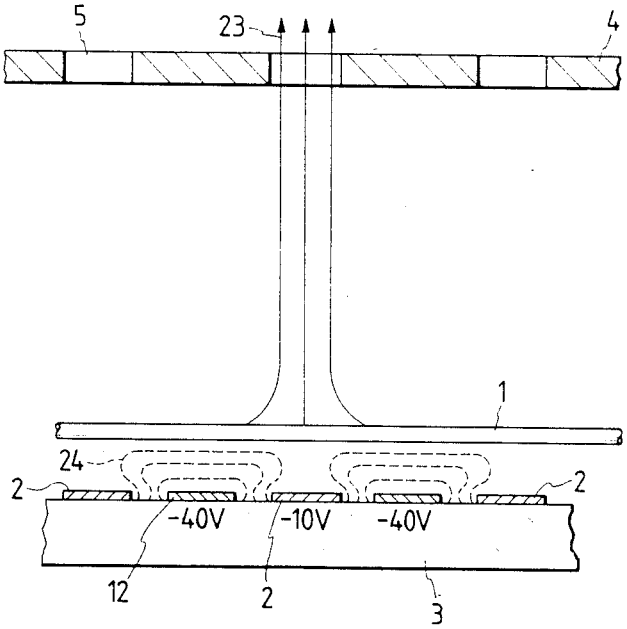
FIG. 5 is a partial expanded cross-sectional view showing relationships between electric fields produced between a beam emission control electrode and adjacent shield electrodes and a resultant electron beam.

In the above description of the embodiment of FIG. 3, use is made of the fact that the beam current of a specific electron beam can be adjusted by varying the voltage applied to shield electrodes which are immediately adjacent to a electron beam control electrode which is used to modulate that electron beam. However as is clear from FIG. 4, the beam current will reach a maximum value at a certain value of shield electrode voltage (e.g. a shield electrode voltage of approximately 40 V in the case of the example of FIG. 4). In addition, variation of the shield electrode voltage will result in variation of the cut-off voltage of the electron beam control electrodes. This will be described referring to FIG. 5, which is an expanded partial plan cross-sectional view of a CRT of the type shown in FIG. 1 or FIG. 3, illustrating how emission of a single electron beam 23 is controlled by one of the beam control electrodes 2 in conjunction with the two shield electrodes which are positioned on either side of that electron beam control electrode. In FIG. 5 it is assumed that −40 V is applied to the shield electrodes 12, and −10 V is applied to the electron beam control electrodes 2, whereby the lines of equipotential distribution 24 of the electric field produced by the beam control electrodes 2 and shield electrodes 12 are as shown by the broken-line curves, with electric field force acting in a direction from the shield electrodes 12 to the electron beam control electrodes 2. As a result of this effect, each electron beam 23 that is produced from the line cathodes 1 will be subjected to forces which cause the beam to be concentrated at its center, when the aforementioned voltage values are applied to the respective electrodes. It can thus be understood that as the shield electrode voltage is made increasingly negative, the electron beam current will be correspondingly increased. However if the shield electrode voltage is made more negative than a certain optimum value, then each electron emission region of the line cathodes 1 will be gradually reduced, so that the electron beam current will also be reduced. That is to say, if the shield voltage is made substantially more negative than the aforementioned optimum value, then the electric field produced by the shield electrodes 12 will penetrate into the space above the electron beam control electrode 2, thereby reducing the beam current. It is for this reason that a maximum level of beam current is obtained at a certain optimum value of shield electrode voltage. Moreover, as the electron emission region is thus reduced by making the shield electrode voltage increasingly negative, the (absolute) magnitude of the cut-off voltage of the electron beam control electrode 2 will be reduced.

Figure 6:
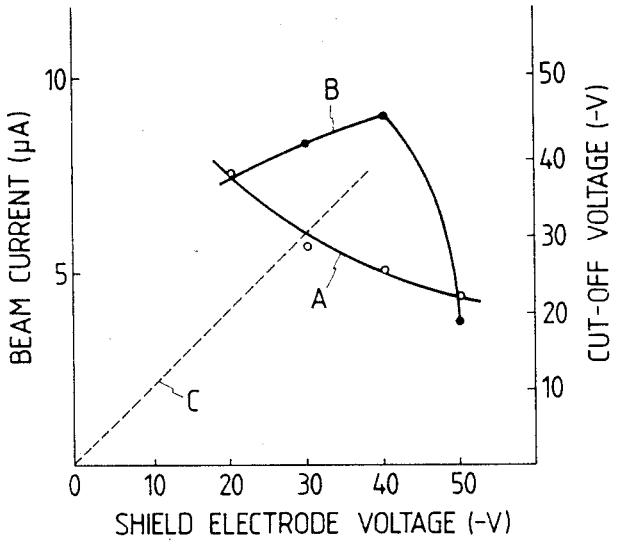
FIG. 6 is a graph showing a relationship between shield electrode voltage and emitted electron beam current together with a relationship between shield electrode voltage and a cut-off voltage level of beam control electrodes of a flat configuration CRT.

FIG. 6 shows the results of measurement data which graphically illustrate the above points, showing the variation of the cut-off voltage of an electron beam control electrode 2 (graph A) and the corresponding electron beam current which passes through the corresponding aperture 5 of the first grid electrode 4 (graph B) in response to changes in the voltage that is applied to the shield electrodes 12 which are immediately adjacent to that control electrode 2. As will be clear from FIG. 6, as the voltage applied to the shield electrodes is made increasingly negative, the (absolute value of) cut-off voltage of the electron beam control electrodes is correspondingly reduced. Graph B also illustrates that when the shield voltage reaches a certain value, the electron beam current reaches a maximum value as described above. The point of intersection between the broken line C in FIG. 6, (which is at 45° to the graph axes) and the cut-off voltage graph A represents a point at which the shield voltage and the cut-off voltage are mutually identical. The value of shield voltage for which the electron beam current reaches a maximum is more negative than the value of shield voltage at the aforementioned point of intersection. Thus, in order to efficiently extract the electron beam current, the shield electrode voltage must be made more negative than the corresponding value of electron beam control electrode cut-off voltage by a specific amount, to thereby utilize an operating region in which the electron beam current reaches a maximum value.

Based on the above points, the following test results have been obtained for a flat configuration CRT having the form shown in FIG. 1:

Pulse (bias) voltage applied to the line cathodes 1 . . . −10 V

Pulse voltage applied to the electron beam control electrodes 2 . . . −10 V

Voltage applied to the shield electrodes 12 . . . −40 V

Voltage applied to the first grid electrode 4 . . . 40 V

Spacing between line cathodes 1 and electron beam control electrodes 2 . . . 0.2 mm Spacing between line cathodes 1 and first grid electrode 4 . . . 1.0 mm Dimensions of each through-hole 5 in the first grid electrode 4 . . . 0.2 mm×0.4 mm With a flat configuration CRT having the above specifications, it is found that a maximum electron beam current of 9 μA is obtained through each of the through-holes 5. It can thus be understood that efficient extraction of the electron beams is achieved.

Moreover, although the above values assume that each of the shield electrodes is subjected to a fixed optimum value of voltage (i.e. −40 V), it will be apparent that substantially identical results to the above can be obtained for the embodiment of FIG. 3 of the invention. Specifically, if an initial voltage value for each of the voltage sources 22 is made close to but slightly different from that optimum voltage value, the output value from each of the voltage sources can thereafter be adjusted from that initial value such as to increase or decrease the electron beam emission levels of the respective electron beams as described hereinabove referring to FIG. 4, such as to establish uniform beam current levels for all of the electron beams. Thus, it becomes possible with the embodiment of the invention of FIG. 3 to set the emission level of each electron beam to a uniform level which is close to an optimum level.

What is claimed is:

1. In a flat configuration cathode ray tube comprising a plurality of electron beam control electrodes and plurality of shield electrodes, said electron beam control electrodes and shield electrodes each being of elongated form and arrayed at mutually alternating positions adjacent to at least one line cathode and oriented at right angles to said line cathode, the improvement whereby said shield electrodes are configured as a plurality of blocks each formed of a fixed plurality of said shield electrodes, and further comprising a plurality of adjustable DC voltage sources coupled to respective ones of said blocks.

2. A flat configuration cathode ray tube according to claim 1, in which said DC voltage sources produce respective fixedly predetermined output voltages during operation of said cathode ray tube.

3. A flat configuration cathode ray tube according to claim 1, in which said cathode ray tube comprises a plurality of said line cathodes for deriving successive rows of electron beams during respectively corresponding fixed time intervals within each of successive vertical scanning intervals, and in which said DC voltage sources produce respective different sets of fixedly predetermined output voltages during said fixed time intervals.

4. A flat configuration cathode ray tube according to claim 1, in which for each of said voltage sources, an output voltage produced therefrom is set to a value which is more negative than a corresponding value of cut-off voltage of an electron beam control electrode which is disposed within one of said blocks which receives said output voltage.

* * * * *